US007859475B2

(12) United States Patent
Gierow et al.

(10) Patent No.: US 7,859,475 B2
(45) Date of Patent: Dec. 28, 2010

(54) ANTENNA POSITIONING SYSTEM

(75) Inventors: Paul A. Gierow, Madison, AL (US); William R. Clayton, Madison, AL (US)

(73) Assignee: GATR Technologies, Huntsville, AL (US)

( * ) Notice: Subject to any disclaimer, the term of this patent is extended or adjusted under 35 U.S.C. 154(b) by 0 days.

(21) Appl. No.: 12/836,178

(22) Filed: Jul. 14, 2010

(65) Prior Publication Data

US 2010/0277384 A1 Nov. 4, 2010

Related U.S. Application Data

(63) Continuation of application No. 11/893,064, filed on Aug. 14, 2007, now Pat. No. 7,764,243.

(60) Provisional application No. 60/838,085, filed on Aug. 16, 2006.

(51) Int. Cl.
*H01Q 3/00* (2006.01)

(52) U.S. Cl. ..... 343/766; 343/763; 343/882; 343/915

(58) Field of Classification Search ..... 343/763, 343/766, 882, 915
See application file for complete search history.

(56) References Cited

U.S. PATENT DOCUMENTS 4,672,389 A * 6/1987 Ulry ..... 343/915
5,952,979 A * 9/1999 Choi ..... 343/766
6,329,956 B1 * 12/2001 Tateishi et al. ..... 343/753

* cited by examiner

*Primary Examiner*—Douglas W Owens
*Assistant Examiner*—Dieu Hien T Duong
(74) *Attorney, Agent, or Firm*—George P. Kobler; Lanier Ford Shaver & Payne, P.C.

(57) ABSTRACT

An apparatus for positioning and controlling a spherical, inflatable antenna includes a driven rotating table disposed in the horizontal plane which supports and drives a horizontal arm member to which is hingedly connected first and second upright support members at either end. The upright support members include journal bearings attachable to the surface of an inflatable antenna.

14 Claims, 5 Drawing Sheets

DEPLOYED

PARTIALLY STOWED

ANTENNA POSITIONING SYSTEM

CROSS-REFERENCE TO RELATED APPLICATIONS

This application is a continuation of U.S. application Ser. No. 11/893,064, now U.S. Pat. No. 7,764,243, which claims priority to U.S. Provisional Application 60/838,085, filed Aug. 16, 2006, and which is incorporated by reference herein.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. W9113M-05-0085 awarded by the U.S. Army.

FIELD OF THE INVENTION

This invention relates generally to positioning systems for antennas, and specifically to positioning systems for readily deployable, inflatable antennas.

BACKGROUND

In remote areas, or in emergency situations, it is difficult if not impossible to establish communications with satellite networks or other sorts of networks. Portable, inflatable antennas have been developed to solve this problem. Apparatuses for supporting, positioning, and controlling such antennas are needed however.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

Figure 1:
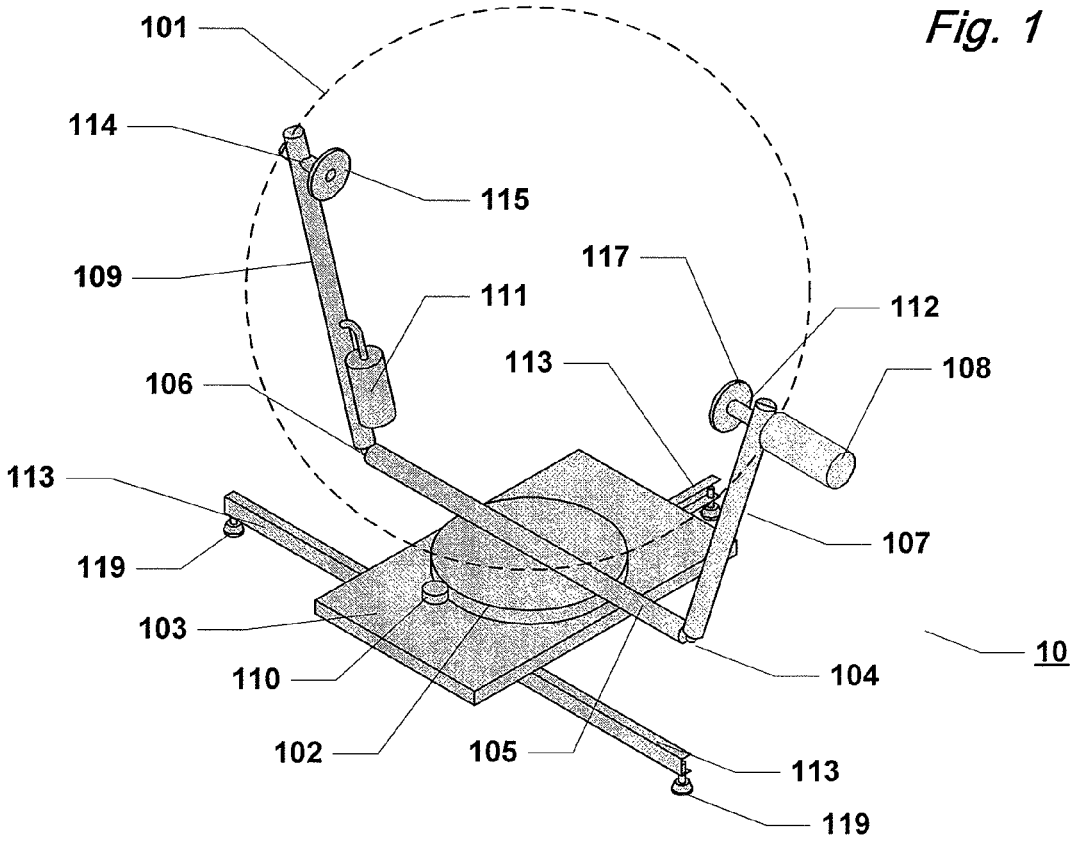
FIG. 1 depicts one exemplary embodiment of a an antenna positioning apparatus.

The various embodiments of the present invention and their advantages are best understood by referring to FIGS. 1 through 6 of the drawings. The elements of the drawings are not necessarily to scale, emphasis instead being placed upon clearly illustrating the principles of the invention. Throughout the drawings, like numerals are used for like and corresponding parts of the various drawings.

Furthermore, reference in the specification to "an embodiment," "one embodiment," "various embodiments," or any variant thereof means that a particular feature or aspect of the invention described in conjunction with the particular embodiment is included in at least one embodiment of the present invention. Thus, the appearance of the phrases "in one embodiment," "in another embodiment," or variations thereof in various places throughout the specification are not necessarily all referring to its respective embodiment. Moreover, features described with respect to a particular embodiment may also be employed in other disclosed embodiments as those skilled in the relevant arts will appreciate. This invention may be provided in other specific forms and embodiments without departing from the essential characteristics as described herein. The embodiments described below are to be considered in all aspects as illustrative only and not restrictive in any manner Referring to FIG. 1, a positioning system 10 for a portable, collapsible antenna includes a base assembly, having a platform, or base plate 103, upon which is mounted an azimuth drive assembly 102. A horizontal arm 105 is fastened through its lengthwise midpoint to azimuth drive assembly 102, with the horizontal arm 105 having opposing free ends. At each of the opposing free ends, generally upright support members 107, 109 are pivotally connected to permit the upright support members 107, 109 to be folded for transport. Pivoting connections 104, 106 should be lockable to insure that support members 107, 109 do not collapse during operation but remain in a deployed extended position. In addition, a folding brace (not shown), lockable in its extended position, may be used between the horizontal arm 105 and the upright support members 107, 109 to further insure against collapse during deployment. Lockable pivoting connections also insure that stowed upright support members remain stowed. Each upright support member 107, 109 includes a horizontal journal bearing 112, 114 mounted on the inward sides of the end of the upright support members 107, 109 distal from the pivoting connections 112, 114 to the horizontal arm 105. At least one upright support member 107 includes an elevation drive actuator 108. Journal bearings 112, 114 include antenna structural interface means 115, 117 for attaching the antenna to the journal bearings 112, 114. Depending upon the weight of the antenna 101, a force amplifier 110 may be used to augment azimuth drive assembly.

Antenna structural interface means 115, 117 are generally disc-shaped members having a plurality of apertures through each of which is mounted a quarter-turn screw fastener. Attached to the wall of the antenna dome is a corresponding disc member (not shown) having a plurality of apertures corresponding to the number of quarter-turn fasteners. To attach the antenna to the structural interface means 115, 117, the quarter-turn fasteners of the interface means are inserted into the corresponding apertures in the disc on the antenna wall and turned. It may be preferable to color-code the fasteners and their corresponding apertures to help expedite set and insure proper orientation of the antenna 101.

Base plate 103 may be mounted upon three or more stabilizing struts 113 that extend outwardly from the base plate 103. Stabilizing struts 113 may include "outrigger" type struts that are generally perpendicular to the longitudinal axis of the base plate, with a single strut extending beyond the base plate along its longitudinal axis. In the alternative, stabilizers may extend from base plate at any angle. It should be noted that although base plate 103 is shown as rectangular, base plate may be any suitable shape. A rectangular base plate has an advantage in tending to need less space when the apparatus is being stored or transported. However there may be instances where a base plate of a non-rectangular shape may be used. For example, an ovoid base plate provides the benefit of a lack of sharp corners. Struts may be fixed, or may be collapsible. They may be hinged so that they may fold underneath the base plate, or may be telescopically collapsible. In either case, they should have locking mechanisms to prevent undesired collapsing of the base assembly. Stabilizer struts may also have feet 119 extending downwardly therefrom which may be adjustable.

It is also preferable to include means for securing pivoting or movable parts in the stowed position. For example, horizontal arm may have a pin and hasp, and the base may have an aperture in its upper surface for receiving the pin located generally so that horizontal arm is locked in a stowed position within the perimeter of the base plate. It will be apparent to those skilled in the relevant arts that other means for securing the stowed position of the horizontal arm, and upright support members, may be used, for example, clamps, clasps, straps, etc.

Components of the positioning system are made from any suitable rigid, lightweight, yet durable materials. Metals, such as aluminum, including alloys, may be used. In addition, those skilled in the arts will recognize that the components made be formed from composite and polymeric materials. Moreover, to achieve even lighter weight, components need not be solid. For example, base plate may be a layered structure having two solid outer layers laminated to a corrugated or honey-combed inner structure. Horizontal arm 105 and upright support arms 107, 109 may be hollow tubing.

It is anticipated that the collapsible antenna positioning apparatus described above may be employed with a variety of antennas, including without limitation, rigid, semi-rigid and inflatable antennas. For an example of such inflatable antennas please see U.S. Pat. No. 6,963,315, to Gierow, et al, which is incorporated herein by reference. An inflatable antenna as contemplated herein is essentially a two-chamber, gas-filled sphere where a partition between the two chambers is maintained the shape of a parabolic dish, or lenticular. The partition reflects energy to or from a feed horn assembly mounted in the surface of the sphere. The parabolic shape of the reflector may be maintained by having higher air pressure in the chamber on the reflecting side of the partition, than in the chamber on the opposing side.

In an embodiment where the positioning apparatus is coupled with such an inflatable antenna, a blower apparatus 111 may be mounted to either or both support arms with piping for communicating gas from the blower apparatus into the inflatable antenna chamber or chambers. In the instance that upright support arms are formed from hollow tubing, piping may be housed within the upright support arms.

Figure 2A:
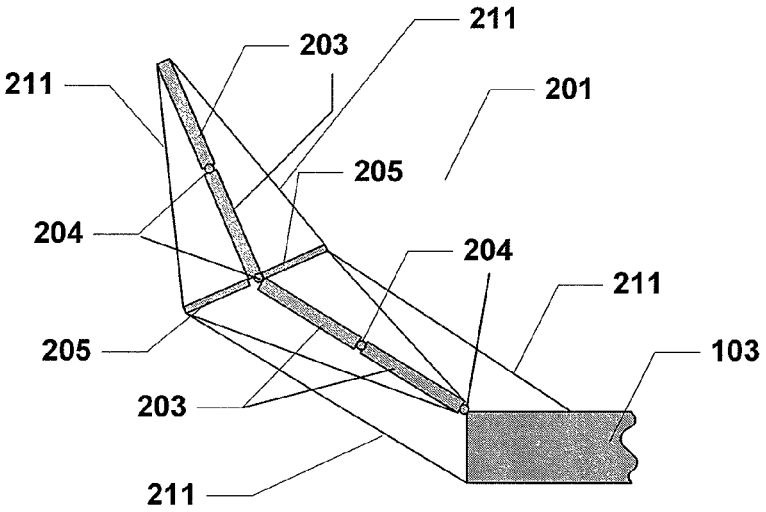
FIG. 2A depicts an embodiment of a collapsible support arm in an extended position.
Figure 2B:
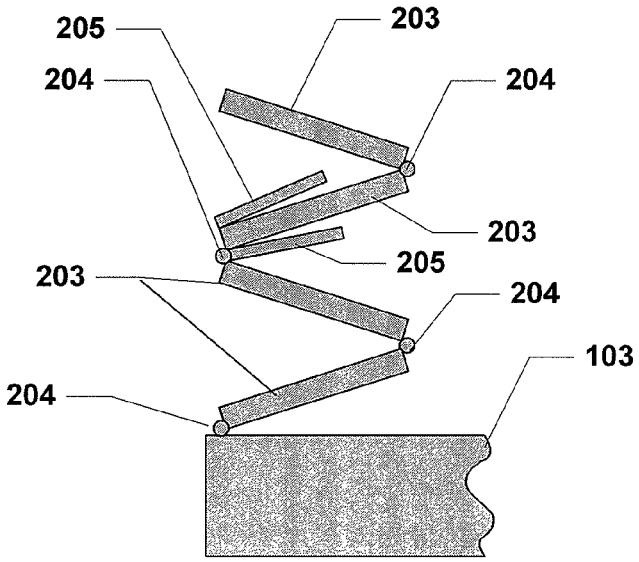
FIG. 2B depicts the embodiment of FIG. 2A in a partially collapsed position.

Upright supports could also be further articulated to further minimize stowed volume. With reference to FIG. 2A, upright support 201 is shown comprising a plurality of columns 203 connected end-to-end by hinges 204 that are lockable in the extended position. A cross member 205 is hingedly attached to one of the columns 203 at a point generally midway between the outer end and the base 103. Tension members 211, which may be a unitary piece or separate pieces, extend from the outer end of the extended columns and is secured to the base 103 to provide compression tension on the columns. Tension members 211 may be comprised of wire, cable, ribbon, or the like. FIG. 2B shows the upright support 201 is a partially stowed position. Column hinges 204 are configured to pivot in opposite directions to each other. This results in an "accordion" fold of the column components 203. Cross members 205 are likewise pivotally connected to column member in order to fold back upon column the column member as shown in the figure.

Figure 3:
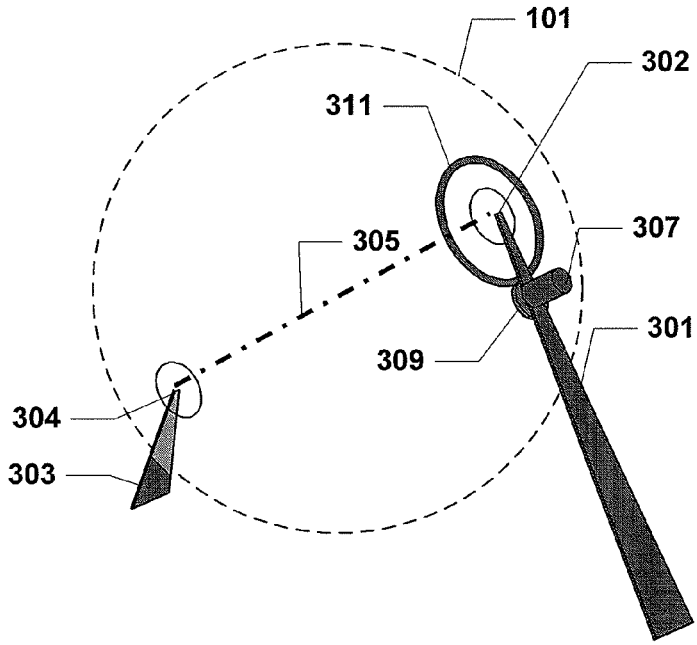
FIG. 3 depicts an embodiment for use in tracking geo-stationary satellites.

Further embodiments provide an apparatus for controlling the position of inflatable antennas used in communication with geo-stationary satellites. Referring to FIG. 3, first and second support members 301, 303 are pivotally connected to either pole 302, 304 of an inflatable antenna 101 to allow rotation of the pivot points about the poles 302, 304, with first support member 301 being longer than second support 303 member so that when the antenna 101 is mounted, its rotational axis 305 is parallel with the earth's rotational axis. A first support member 301, here shown pivotally connected to an upper pivot 302, is mounted with a rotational drive actuator 307 for driving rotation of the antenna. The drive actuator rotates a gear 309 which is engaged with a ring gear 311 affixed to the antenna surface concentrically about the pole pivot 302. Rotation of the gear by the drive actuator therefore results in rotation of the ring gear and, thus, rotation of the antenna globe.

It should be noted that although support members 301, 303 are shown in the figure to be solid triangular members, support members may be any shape or dimension that provides mounting support for the antenna. For example, support members could be tripodal, or tetrapodal. Further, support members could be adjustable in height so that rotational axis of the antenna may be maintained parallel with the earth's rotational axis. Support members may also be collapsible, and may be the type described with reference to FIGS. 2A, and 2B above.

Figure 4:
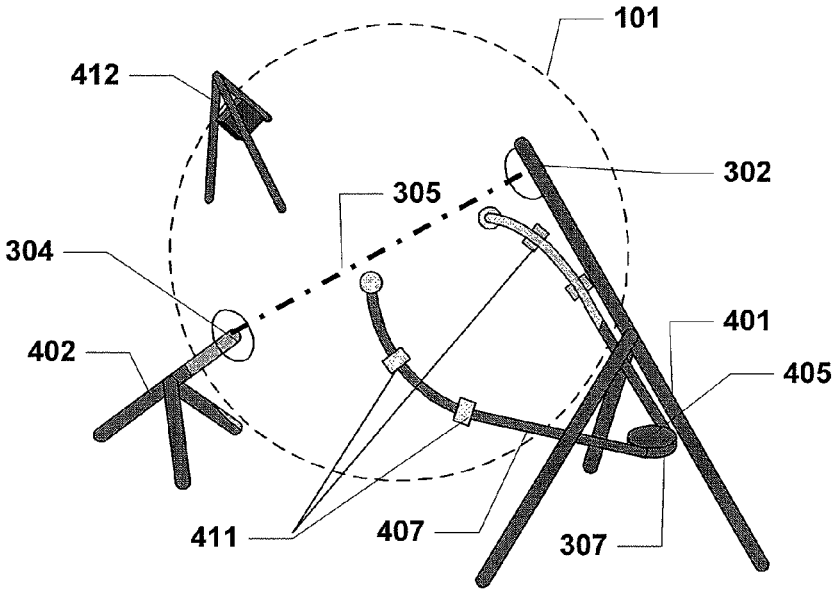
FIG. 4 depicts a further embodiment for use in tracking geo-stationary satellites.

Another exemplary embodiment of a positioning system for use with satellite tracking antennas is shown in FIG. 4. Inflatable antenna 101 is shown again oriented such that its rotational axis 305 is parallel with the earth's rotational axis. First and second support members 401, 402, in this example are implemented with tripods, and are pivotally attached to the poles 302, 304 of the antenna's rotational axis. In this embodiment, drive actuator 307 is mounted in the legs of first support member 401 and rotationally drives a pulley or a gear 405 that is engaged with a drive cable 407, which could also be a timing chain or the like. The drive cable has opposing ends that are attached to areas of the surface on opposing sides of the inflatable antenna 101. A plurality of cable guides 411 is attached to the surface of the antenna in configuration to guide the drive cable 407.

In either of the embodiments described with reference to FIGS. 3 and 4, the inflatable antenna 101 may be mounted with a structure for support of instrumentation such as an inclinometer and a compass. For example, FIG. 4 shows an instrumentation tripod 412 attached to the surface of the antenna 101 in which is suspended such instrumentation.

Figure 5:
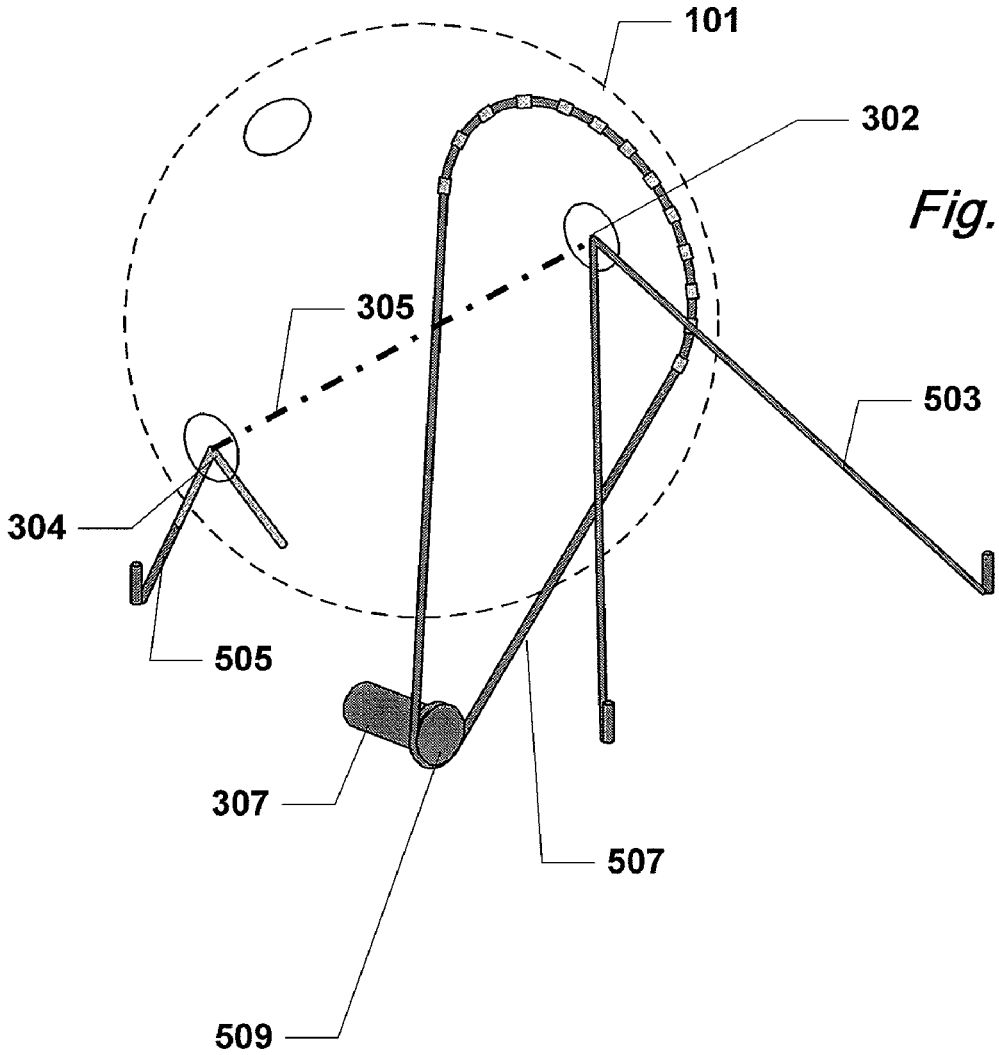
FIG. 5 depicts a further embodiment for use in tracking geo-stationary satellites.

In a further embodiment shown in FIG. 5, a less rigid and more portable version is disclosed. The inflatable antenna 101 rests directly on the ground, or floor. The rotational axis 305 is kept parallel with the earth's rotational axis with stays 503, 505, which may be achieved with cables, anchored to the ground. The cables 503, 505 are attached to the respective poles 302, 304 to allow pivoting about the rotational axis 305. This may be achieved in a variety of ways known in the relevant arts. A drive actuator 307 is disposed to one side of the apparatus and rotates a pulley or gear 509 that engages a looped drive cable 507, or timing chain or belt. The drive cable 507 extends to loop around a 302 pole of the antenna 101 and is attached to the surface thereof. The drive actuator 307 rotates the pulley or gear 509 engaged with the cable 507 which pulls the cable and, thus, rotates the antenna. Again, drive actuator 307 may include a force amplifier.

Figure 6:
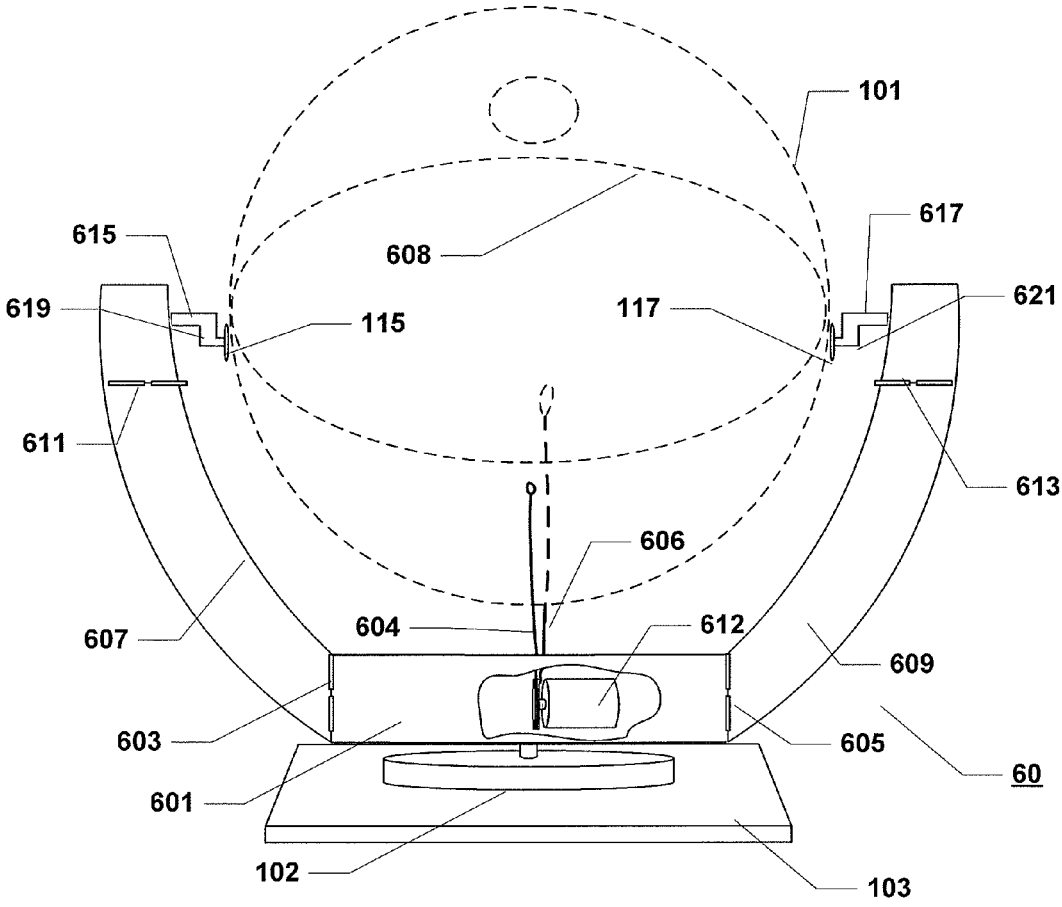
FIG. 6 illustrates an elevational view of another embodiment of an exemplary positioning apparatus for an inflatable antenna

FIG. 6 shows yet another embodiment of a positioning system 60 for an inflatable antenna 101. In this case, the antenna is controlled in elevation as well as azimuth, similar to the embodiment described with reference to FIG. 1. Horizontal arm 601 is a generally box-shaped hollow structure at either end of which is attached hinges 603, 605. Hinges 603, 605 are also attached to upright support members 607, 609. Upright support members 607, 609 are shown in this example as curved box structures and may also be hollow. Each upright support member 607, 609 may optionally include a second set of hinges 611, 613 to further articulate the structure. It will be noted that the horizontal arm hinges 603, 605 enable pivoting of the upright support members in the horizontal plane, and the upright support member hinges 611, 613 enable pivoting of the attachment assembly structure in the vertical plane. Each of these hinged connections is also preferably lockable, using a pin and hasp combination, clasps, clamps, or any suitable means to insure that once in the extended deployed position, the structure does not collapse at the hinge points.

Mounted to the inward side of each upright support member 607, 609 is a journal bearing 615, 617 for allowing pivoting in the elevation plane. Each journal bearing 615, 617 supports an attachment mount support 619, 621 in parallel offset from the axis of the journal bearing. In some embodiments, attachment mount support 619, 621 may be a second journal bearing. Each attachment mount support 619, 621 then supports antenna structural interface means 115, 117. The purpose behind providing this offset attachment point is so that the interface structures on the antenna sphere surface do not interfere with the partition, illustrated in the figure in dashed lines at 608, within the sphere. In other words, the partition which acts as the parabolic reflector may be attached within the sphere and the equator thereof. The offset attachment points permit attachment of the sphere to the upright supports while providing a pivot points that define the axis of rotation for the sphere in the elevation plane.

Horizontal arm 601 is pivotally mounted to azimuth drive assembly 102 mounted upon a base 103. Azimuth drive assembly 102 rotates horizontal arm 601 and thus positions the apparatus and the antenna in the azimuth plane. In this example, an elevation drive assembly 612 is mounted within horizontal arm 601 and is connected to a pulley, or gear, which is engaged with a single or a pair of cables, or chains 604, 606. The free ends of the cables 604, 606 are connected to the surface of the sphere, through loops or hooks, or the like. Optionally, cable attachment points may located roughly opposite each other on the sphere. In operation, cables should be of a length and the attachment points located to result in the least amount of slack possible. This stabilizes the sphere, and thus the parabolic reflector, in the elevation plane. In operation, elevation drive assembly rotates the pulley which pulls the cable in a given directed, or in the case of using two cables, the pulley pulls one cable. This action rotates the sphere about its axis in the elevation plane.

In all of the cases discussed hereinabove, the drive actuators may be achieved with off-the-shelf drive mechanisms such as those used for driving the positioning of telescopes. Those skilled in the relevant arts will appreciate that drive mechanism is reversible, able to provide clockwise and counter-clockwise torque when commanded. This may be accomplished in many ways known in the arts. The motor itself maybe commanded to operate with reverse polarity. Alternatively, reversing direction of pull may be achieved mechanically.

Control of the drive mechanisms and other functions of the antenna positioning system may be implemented with a computer system (not shown) configured with program logic to cause the computer system to execute the functions required. For example, with respect to the drive mechanism, control logic for the computer would direct energizing and de-energizing of the drive mechanism when required to rotate the antenna to the required position.

The detailed description that follows is presented largely in terms of processes and symbolic representations of operations performed by conventional computers, including computer components. A computer may be any microprocessor or processor (hereinafter referred to as processor) controlled device, such as, by way of example, personal computers, workstations, servers, clients, mini-computers, main-frame computers, laptop computers, a network of one or more computers, mobile computers, portable computers, handheld computers, palm top computers, set top boxes for a TV, interactive televisions, interactive kiosks, personal digital assistants, interactive wireless devices, mobile browsers, or any combination thereof. The computer may possess input devices such as, by way of example, a keyboard, a keypad, a mouse, a microphone, or a touch screen, and output devices such as a computer screen, printer, or a speaker.

The computer may be a uniprocessor or multiprocessor machine. Additionally, the computer includes memory such as a memory storage device or an addressable storage medium. The memory storage device and addressable storage medium may be in forms such as, by way of example, a random access memory (RAM), a static random access memory (SRAM), a dynamic random access memory (DRAM), an electronically erasable programmable read-only memory (EEPROM), a programmable read-only memory (PROM), an erasable programmable read-only memory (EPROM), hard disks, floppy disks, laser disk players, digital video disks, compact disks, video tapes, audio tapes, magnetic recording tracks, electronic networks, and other devices or technologies to transmit or store electronic content such as programs and data.

The computer executes an appropriate operating system such as Linux, Unix, Microsoft® Windows® 95, Microsoft® Windows® 98, Microsoft® Windows® NT, Apple® MacOS®, IBM® OS/2®, and later versions thereof. The computer may advantageously be equipped with a network communication device such as a network interface card, a modem, or other network connection device suitable for connecting to one or more networks.

The computer, and the computer memory, may advantageously contain program logic or other substrate configuration representing data and instructions, which cause the computer to operate in a specific and predefined manner as, described herein. The program logic may advantageously be implemented as one or more modules. The modules may advantageously be configured to reside on the computer memory and execute on the one or more processors. The modules include, but are not limited to, software or hardware components that perform certain tasks. Thus, a module may include, by way of example, components, such as, software components, processes, functions, subroutines, procedures, attributes, class components, task components, object-oriented software components, segments of program code, drivers, firmware, micro-code, circuitry, data, and the like.

The program logic conventionally includes the manipulation of data bits by the processor and the maintenance of these bits within data structures resident in one or more of the memory storage devices. Such data structures impose a physical organization upon the collection of data bits stored within computer memory and represent specific electrical or magnetic elements. These symbolic representations are the means used by those skilled in the art to effectively convey teachings and discoveries to others skilled in the art.

The program logic is generally considered to be a sequence of computer-executed steps. These steps generally require manipulations of physical quantities. Usually, although not necessarily, these quantities take the form of electrical, magnetic, or optical signals capable of being stored, transferred, combined, compared, or otherwise manipulated. It is conventional for those skilled in the art to refer to these signals as bits, values, elements, symbols, characters, text, terms, numbers, records, files, or the like. It should be kept in mind, however, that these and some other terms should be associated with appropriate physical quantities for computer operations, and that these terms are merely conventional labels applied to physical quantities that exist within and during operation of the computer.

It should be understood that manipulations within the computer are often referred to in terms of adding, comparing, moving, searching, or the like, which are often associated with manual operations performed by a human operator. It is to be understood that no involvement of the human operator may be necessary, or even desirable. The operations described herein are machine operations performed in conjunction with the human operator or user that interacts with the computer or computers.

It should also be understood that the programs, modules, processes, methods, and the like, described herein are but an exemplary implementation and are not related, or limited, to any particular computer, apparatus, or computer language. Rather, various types of general purpose computing machines or devices may be used with programs constructed in accordance with the teachings described herein. Similarly, it may prove advantageous to construct a specialized apparatus to perform the method steps described herein by way of dedicated computer systems with hard-wired logic or programs stored in nonvolatile memory, such as, by way of example, read-only memory (ROM).

As described above and shown in the associated drawings, the present invention comprises an apparatus for an antenna positioning system. While particular embodiments of the invention have been described, it will be understood, however, that the invention is not limited thereto, since modifications may be made by those skilled in the art, particularly in light of the foregoing teachings. It is, therefore, contemplated that any claims issuing in an ensuing patent will cover any and all such modifications that incorporate those features or those improvements that embody the spirit and scope of the present invention.

We claim:

1. An apparatus for positioning and controlling a spherical, inflatable antenna having an axis of rotation defining first and second poles comprising:

first and second support members pivotally connected to said first and second poles, respectively, configured to maintain the axis at an angle with respect to a local horizon with said first pole positioned higher than said second pole;

a motor configured to impart rotation; and a transmission element attached to the surface of said spherical antenna and configured to transmit said motor rotation to said spherical antenna whereby said antenna may be rotated about said axis;

a ring gear affixed to the surface of said inflatable antenna concentrically about said first pole; and a gear rotated by said motor and engaged with said ring gear.

2. The apparatus of claim 1 wherein the height of said first and second support members is adjustable.

3. The apparatus of claim 1 wherein said first and second support members are collapsible.

4. The apparatus of claim 1, further comprising at least one of a compass and an inclinometer.

5. The apparatus of claim 1, wherein said transmission element is a ring gear attached to the surface of said spherical antenna concentric with said axis of rotation and said motor rotates a driven gear engaged with said ring gear.

6. The apparatus of claim 5, further comprising at least one of an inclinometer and a compass.

7. The apparatus of claim 1, wherein said transmission element comprises a band having two opposing ends attached to the surface of said spherical antenna and engaged with a pulley driven by said motor.

8. The apparatus of claim 7, further comprising a plurality of guides attached to the surface of said inflatable antenna for retaining said belt against the surface.

9. The apparatus of claim 8, further comprising at least one of an inclinometer and a compass.

10. The apparatus of claim 1, wherein said transmission element comprises a continuous band engaged with a pulley driven by said motor, said band having a loop portion attached to the surface of said spherical antenna forming an arc around said first pole.

11. The apparatus of claim 10, wherein said first and second support members comprise:

a first cable pivotally connected to a first pole of the rotational axis of said inflatable antenna, said first cable having first and second ends anchored to a substrate; and a second cable pivotally connected to a second pole of the rotational axis of said inflatable antenna, said second cable having first and second ends anchored to said substrate.

12. The apparatus of claim 11, further comprising a plurality of guides for attaching said loop portion to said spherical antenna surface wherein said plurality of guides are positioned in an arc around said first pole.

13. The apparatus of claim 11, wherein said band is one of a cable, a timing chain and a belt.

14. The apparatus of claim 13, further comprising at least one of an inclinometer and a compass.

* * * * *

UNITED STATES PATENT AND TRADEMARK OFFICE

CERTIFICATE OF CORRECTION

PATENT NO. : 7,859,475 B2
APPLICATION NO. : 12/836178
DATED : December 28, 2010
INVENTOR(S) : Paul A. Gierow and William R. Clayton It is certified that error appears in the above-identified patent and that said Letters Patent is hereby corrected as shown below:

Col. 1, lines 14-18 should read,

"The U.S. Government has a paid-up license in this invention and the right in limited circumstances to require the patent owner to license others on reasonable terms as provided for by the terms of Contract No. W9113M-06-C-0167 awarded by the U.S. Army."

Signed and Sealed this
Thirty-first Day of July, 2012

David J. Kappos

David J. Kappos
*Director of the United States Patent and Trademark Office*